United States Patent [19]

Gunderson

[11] Patent Number: 4,626,136

[45] Date of Patent: Dec. 2, 1986

[54] PRESSURE BALANCED BUOYANT TETHER FOR SUBSEA USE

[75] Inventor: Richard H. Gunderson, Houston, Tex.

[73] Assignee: Exxon Production Research Co., Houston, Tex.

[21] Appl. No.: 775,915

[22] Filed: Sep. 13, 1985

[51] Int. Cl.[4] ..... E02B 17/00

[52] U.S. Cl. ..... 405/224; 166/350; 175/7; 405/195; 114/265

[58] Field of Search ..... 405/195, 202–208, 405/224–227; 166/350, 359, 367; 175/7; 114/264, 265, 294

[56] References Cited

U.S. PATENT DOCUMENTS

| | | | |
|---|---|---|---|
| 3,017,934 | 1/1962 | Rhodes | 166/350 |
| 3,736,077 | 5/1973 | Dane | 166/350 X |
| 3,858,401 | 1/1975 | Watkins | 405/195 |
| 3,889,747 | 6/1975 | Regan et al. | 166/359 X |
| 3,981,357 | 9/1976 | Walker | 166/359 |
| 4,102,142 | 7/1978 | Lee | 405/195 |
| 4,176,986 | 12/1979 | Taft | 405/211 |
| 4,226,555 | 10/1980 | Bourne et al. | 405/224 |
| 4,285,615 | 8/1981 | Radd | 405/211 |
| 4,403,658 | 9/1983 | Watkins | 166/367 X |
| 4,422,801 | 12/1983 | Hale | 405/195 |
| 4,468,157 | 8/1984 | Horton | 405/224 |
| 4,521,135 | 6/1985 | Silcox | 405/224 |
| 4,557,332 | 12/1985 | Denison et al. | 166/359 X |

FOREIGN PATENT DOCUMENTS

| | | | |
|---|---|---|---|
| 2142285A | 1/1985 | United Kingdom | 405/224 |
| 2142286A | 1/1985 | United Kingdom | 405/224 |

*Primary Examiner*—Dennis L. Taylor

*Attorney, Agent, or Firm*—Richard E. Phillips

[57] ABSTRACT

A pressure balanced tether buoyancy system 12 useful for reducing the load imposed on a tension leg offshore platform 24 by the tethers 10 securing it to the ocean bottom. The tether 10 has tubular tether walls 11 defining a central cavity 15 isolated from the surrounding seawater. A series of bulkheads 25 extend laterally across the interior of the tether 10, dividing it into a series of individual buoyancy cells 31. Each bulkhead 25 is provided with a differential pressure valve 34 establishing selective fluid communication between the two buoyancy cells 31 separated by the bulkhead 25. Preferably, each differential pressure valve 34 is adapted to open in response to a differential pressure across the bulkhead 25 exceeding the differential hydrostatic existing across the vertical distance separating adjacent bulkheads 25. This permits a pressure gradient to be established interior to the tether 10 approximating that of the seawater in which the tether 10 is located. A central access tube 32 can be provided interior to and extending the length of the tether 10. The central access tube 32 can be used to pass tools through the tether 10 and to ballast and deballast individual buoyancy cells 31.

22 Claims, 5 Drawing Figures

PRESSURE BALANCED BUOYANT TETHER FOR SUBSEA USE

TECHNICAL FIELD

The present invention generally concerns buoyant structural elements adapted for subsea use. More specifically, the present invention concerns a buoyant, pressure balanced tether suitable for use in a tension leg platform.

BACKGROUND OF THE INVENTION

Tension leg platforms are a type of marine structure having a buoyant main body secured to a foundation on the ocean floor by a set of tethers. A typical tension leg platform is shown in FIG. 1 of the appended drawings. The point of connection between the buoyant main body and each tether is selected so that the main body is maintained at a significantly greater draft than it would assume if unrestrained. The resulting buoyant force of the main body exerts an upward load on the tethers, maintaining them in tension. The tensioned tethers substantially restrain the tension leg platform from pitch, roll and heave motion induced by waves, current and wind. It is important that the installation tension of the tethers be sufficiently great to ensure that under ordinary wind, wave and tide conditions the tethers are not permitted to go slack.

Tension leg platforms have attracted interest for use in offshore oil and gas production operations in water depths exceeding about 250 meters (820 feet). As water depths exceed 200–350 meters (656–1148 feet) the structure required to support the deck of a jacket or other conventional structure becomes extremely expensive. Tension leg platforms, however, rely on a tensile rather than compressive loading of the structure securing the platform to the ocean floor, and thus largely avoid the depth sensitivities inherent to conventional structures. It has been suggested that tension leg platforms could be employed in depths up to 3000 meters (9840 feet), whereas the deepest present application of a conventional offshore jacket is in a water depth of approximately 412 meters (1350 feet).

Though tension leg platforms avoid many problems faced by conventional platforms, they are subject to their own special problems. The most significant of these concerns buoyancy requirements. The main body of a tension leg platform must be provided with sufficient buoyancy to support not only its own weight, but also the weight of the equipment and crew facilities necessary to oil and gas drilling and producing operations. Further, the main body must also support the load imposed by the tensioned tethers. It is highly desirable to provide the tethers with buoyancy sufficient to offset some or all of their own weight. This decreases the load imposed on the main body by the tensioned tethers, eliminating the need to provide the main body with an additional degree of buoyancy sufficient to support the weight of the tethers. The decreased main body buoyancy requirements decrease the size and cost of the tension leg platform.

United Kingdom patent application No. 2,142,285A, having a priority filing date of June 28, 1983, teaches a tether design in which the tether is provided with significant inherent buoyancy. This benefit is obtained through the use of tubular tethers filled with gas pressurized to a level above the hydrostatic seawater pressure encountered at the lowest point in the tether. This use of pressurized gas prevents tether collapse in deep water applications. A system is provided for monitoring the gas pressure of the tether to detect any leaks that may occur. This design is disadvantageous in that it imposes a differential pressure across the wall of the tether which, near the ocean surface, will exceed the hydrostatic seawater pressure at the ocean floor. For an installation depth of 600 meters (1970 feet) this corresponds to a differential pressure of 6.1 megapascals (890 psi). The tether walls must be designed to withstand this high differential pressure. Also, the joints securing the individual sections of the tether together must include seals sufficient to prevent gas leakage across the great pressure differential. Further, because the tether interior forms a single, continuous channel, the entire tether could flood if a leak developed of sufficient size that air escaped more quickly than it could be replaced by the tether gas pressurization system.

As an alternative to an internal buoyancy system, buoyancy modules can be secured to the outside of submerged members. A riser buoyancy system of this type is shown in U.S. Pat. No. 4,422,801, issued on Dec. 27, 1983. This riser buoyancy system includes a number of individual air cans secured to the outer wall of the riser. Such systems would be disadantageous for use with the tethers of a tension leg platform in that they complicate inspection of the outer surface of the tether for cracks and corrosion. Also, external buoyancy systems increase the effective diameter of the tether relative to tethers having internal buoyancy systems, increasing the forces imposed on the tether by ocean currents and waves.

It would be advantageous to provide a tether buoyancy system which avoids significant pressure differentials across the wall of the tether; which maintains the outer surface of the tether free from buoyancy modules; which is controllably ballastable and deballastable to aid in tether installation and removal; which avoids the need for seals in the joints joining the individual sections of the tether; which remains substantially buoyant in the event of a leak through a tether wall; which can be deballasted continuously as individual sections of the tether are being joined in the course of tether installaion; and which accommodates a simple and reliable method for determining the location of any leak in the tether.

SUMMARY OF THE INVENTION

A pressure balanced buoyant tether is set forth which is especially well suited for use in a tension leg platform. The tether is tubular and is divided by bulkheads into a series of discrete buoyancy cells. Preferably, the tether is composed of a series of connectable tether sections each having a bulkhead at its upper end, each tether section serving as a discrete buoyancy cell. Secured to each bulkhead is a differential pressure valve adapted to permit gas in the buoyancy cell immediately beneath the bulkhead to pass into the buoyancy cell above the bulkhead in response to the existence of a preselected minimum pressure differential across the bulkhead. Preferably, this preselected pressure differential equals the hydrostatic seawater pressure differential across the length of a single tether section. Thus, by maintaining the lowermost buoyancy cell of the tether at the pressure of the surrounding seawater, all other portions of the tether will be automatically maintained at pressures substantially equal to the surrounding seawater. Means are provided for injecting gas into at least the lowermost of the buoyancy cells. Means are also provided for removing any ballast liquid or sea water within at least the lowermost buoyancy cell as gas is injected.

BRIEF DESCRIPTION OF THE DRAWINGS

For a better understanding of the present invention, reference may be made to the accompanying drawings, in which.

These drawings are not intended as a definition of the invention, but are provided solely for the purpose of illustrating certain preferred embodiments of the invention, as described below.

DESCRIPTION OF THE PREFERRED EMBODIMENTS

Figure 2:
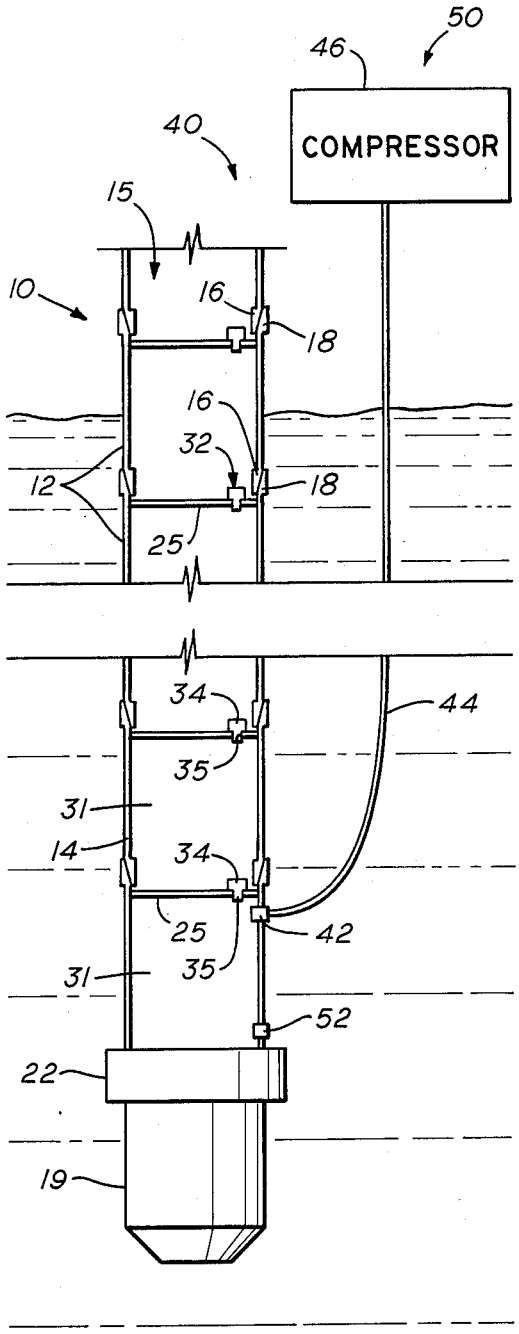
FIG. 2 shows an elevational cross section of a portion of a tension leg platform tether incorporating a preferred embodiment of the present invention.

FIG. 2 shows a diagrammatic view of a preferred embodiment of the pressure balanced buoyant tether 10 of the present invention. As will become apparent in view of the following discussion, the preferred embodiment of the present invention is especially well suited for use in securing a tension leg platform (TLP) to a foundation on an ocean bottom. However, the present invention is also useful in other applications in which it is desirable to provide buoyancy to submerged elements. To the extent that the embodiments described below are specific to TLP tethers, this is by way of illustration rather than limitation.

Figure 1:
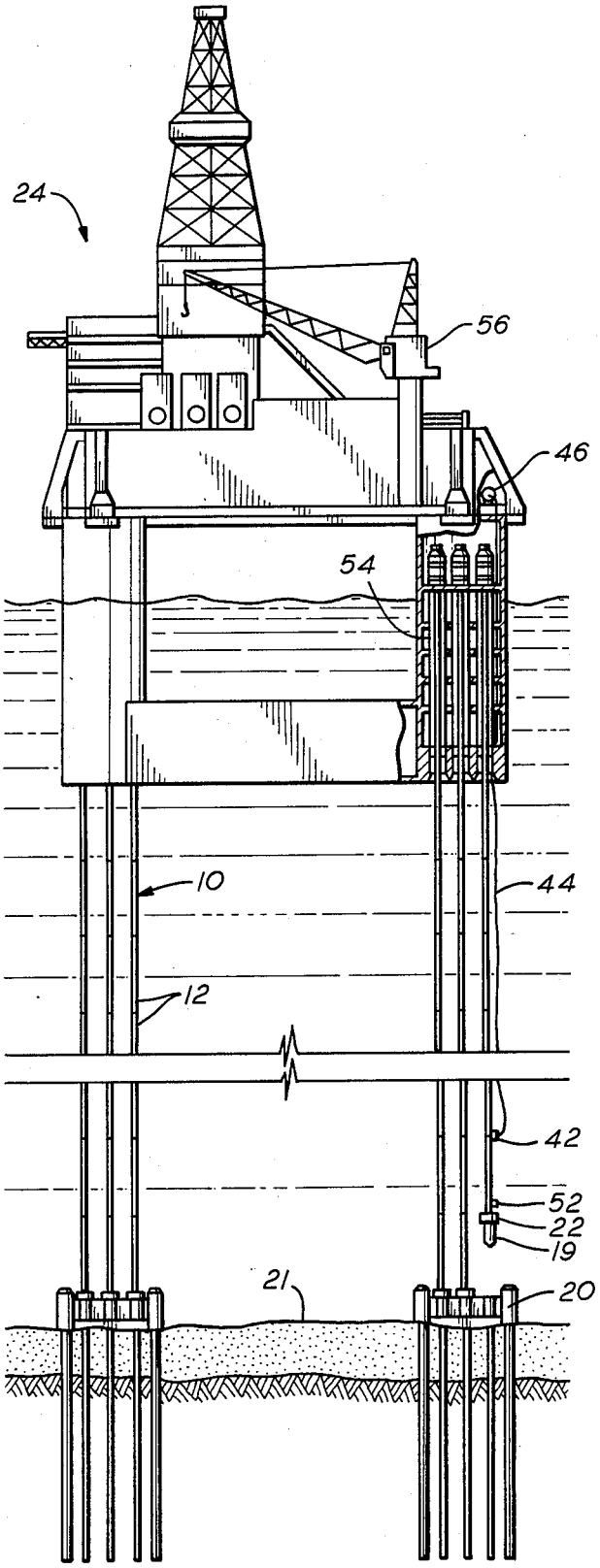
FIG. 1 shows an elevational view of a tension leg platform incorporating the buoyant, pressure balanced tethers of the present invention.

As best shown in FIGS. 1 and 2, the structural portion of each tether 10 is composed of a plurality of tubular sections 12, each having a tubular load bearing wall portion 14 surrounding a central channel 15. Each tether section 12 is provided with a threaded pin 16 at its lower end and a threaded box 18 at its upper end so that the tether sections 12 may be joined one to the other to establish a single elongate tether 10. All but one of the tether sections 12 are of a uniform length, preferably in the range of from 10–50 meters (33–164 feet), with the uppermost tether section 12 having a greater or lesser length as necessary to make the complete tether 10 the precise length required for the application. A base latch 19 is secured beneath the lowermost tether section 12 for locking the tether 10 to a foundation 20 on the ocean floor 21. The base latch 19 is provided with a flexjoint 22 to permit the tether 10 to pivot about the foundation 20 to accommodate limited lateral motion of the TLP 24 in response to wind, waves and ocean currents.

A bulkhead 25 is situated at the upper end of each tether section 14. The bulkhead 25 could alternately be situated at the lower end of each tether section 14; however, as will be appreciated in view of the subsequent disclosure, this would increase the likelihood of leakage at the joint joining individual tether sections and would introduce complications in maintaining pressure integrity of the central access tube (detailed below), if a central access tube is used. When the individual tether sections 12 are threaded together to form the tether 10, the bulkheads 25 divide the interior of the tether 10 into a series of sealed compartments extending along the length of the tether 10, each serving as an individual buoyancy cell 31. As further detailed below, eacy buoyancy cell 31 is filled with gas to provide the tether 10 with the required degree of buoyancy. The tether wall thickness to diameter ratio is established to provide the tether 10 with a preselected degree of buoyancy when the buoyancy cells 31 are completely filled with gas. The wall thickness to diameter ratio of the tether 10 will typically be in the range of from 1:25 to 1:40.

The tether 10 is provided with means 32 for permitting gas to cascade from any buoyancy cell 31 to the buoyancy cell 31 above in response to the existence of a preselected pressure differential between the adjoining buoyancy cells 31. This cascade permitting means 32 allows the internal pressure of the tether 10 to be brought substantially into balance with the external hydrostatic seawater pressure along the full length of the tether 10. In the preferred embodiment the cascade permitting means 32 includes a one-way differential pressure valve 34 situated in a fluid transfer passage 35 extending through each bulkhead 25. Preferably, the differential pressure valve 34 is a diaphragm-assisted pressure relief valve. Each differential pressure valve 34 has an inlet port in fluid communication with the uppermost portion of the buoyancy cell 31 immediately beneath the bulkhead 25 and an outlet port in fluid communication with the lowermost portion of the buoyancy cell 31 immediately above the bulkhead 25. The differential pressure valves 34 are each adapted to open in response to the existence of a preselected pressure differential between its inlet and outlet ports. Preferably, this preselected pressure differential is substantially equal to the hydrostatic seawater pressure differential along the length of an individual tether section 14. Thus, for a tether 10 in which each tether section 14 is 30 meters (98 feet) long, each differential pressure valve 34 should be adjusted to open at a pressure differential of about 300 kPa (44 psi), the hydrostatic pressure of a 30 meter column of sea water. It should be understood that to enhance reliability of the tether buoyancy system more than one differential pressure valve could be provided for controlling fluid transfer through each bulkhead 25.

Means 40 are provided for injecting pressurized gas into the lowermost buoyancy cell 31 of the tether 10. In the preferred embodiment, the lowermost buoyancy cell 31 is provided with a gas injection port 42 to which a fluid transfer umbilical 44 is secured. A compressor 46 situated on the TLP 24 supplies pressurized gas to the umbilical 44. For a group of individual tethers 10, as in a TLP, a separate umbilical 44 can be provided for each tether 10, the umbilical 44 being adapted to remain coupled to the tether 10 at all times. Alternately, the umbilical 44 can be adapted for removal from the tether 10 during those times when it is not required for tether pressurization. In such an embodiment, a single umbilical 44 can be used to service a number of tethers 10. Removal and reattachment of the umbilical 44 is effected by a diver or a remotely operated vehicle ("ROV").

In certain applications it may be desirable to ballast the lower portion of the tether 10 prior to installation or removal. This is advantageous in that the weight of the ballast imposes a tensile load on the tether, minimizing the buckling loads to which the tether 10 is exposed during periods when its lower end is not supported. Preferably water or some other liquid is used as ballast. Means 50 are provided to selectively transfer the liquid ballast to and from the lowermost tether section 12. In the preferred embodiment, the compressor 46 of the gas injection means 40 is also adapted to inject ballast liquid through the fluid transfer umbilical 44 into the lowermost buoyancy cell 31. An ROV operated ballast valve 52 is provided at the bottom of the lowermost tether section to permit liquid ballast to be forced out of the lowermost buoyancy cell 31 to the surrounding ocean water under the pressure of gas injected into the lowermost buoyancy cell 31.

Installation of the tether 10 from the TLP is straightforward. The lowermost tether section 12 is lifted into position above the appropriate tether shroud 54 by the tether handling crane 56. The ballast valve 52 is closed and the tether section 12 is filled with ballast liquid. The umbilical 44 is secured to the gas injection port 42. As additional tether sections 12 are secured to the tether 10 and the tether 10 lowered, gas is injected through the umbilical 44 at a rate sufficient to maintain the differential pressure between the tether 10 and the surrounding seawater low enough to prevent damage to the tether 10 or leakage of seawater into any buoyancy cell 31 through the tether section couplings. As gas is injected, it cascades upward through the differential pressure valves 34 so that the pressure differential between any two adjacent buoyancy cells 31 is equal to the actuation pressure of the differential pressure valves 34. Once the tether 10 is secured to the foundation 20, the ballast valve 52 is opened by an ROV and gas is injected through the umbilical 44 until all ballast liquid has been forced from the lowermost tether section, following which the ballast valve 52 is closed. Following this, additional gas may be injected to raise the pressure of each buoyancy cell 31 a preselected amount, preferably in the range of from 0.07–0.21 MPa (10–30 psi), above the hydrostatic seawater pressure at the base of each tether section 12. The pressure of the uppermost tether section 12 can be monitored to verify proper operation of the cascade permitting means 32. Periodically during use of the tether 10 additional gas should be injected into the lowermost tether section 12 to repressurize any buoyancy cell 31 whose pressure has decreased due to gas leakage or corrosion.

Prior to tether removal, the lowermost tether section is ballasted by injecting ballast liquid through the umbilical 44. The displaced gas cascades upward through the tether 10 via the differential pressure valves 34. Alternately, the ballast valve 52 can be opened and air pressure bled via the umbilical 44 from the lowermost tether section 12, allowing the lowermost tether section 12 to flood with seawater.

Several measures may be taken to minimize internal corrosion of the tether 10. Much potential corrosion can be avoided by excluding sea water from the interior of the tether 10. This is accomplished by maintaining the pressure within each buoyancy cell 31 at a slightly higher level than that of the surrounding seawater, as detailed previously. The ballast liquid used in tether installation and removal is preferably a liquid which will not support corrosion, such as ethylene glycol. However, if water is used, it should have a low ion concentration and should include suitable corrosion inhibitors. Additionally, the gas injected into the tether 10 is preferably a relatively inert gas, such as nitrogen, rather than air. If air is used to pressurize the tether 10, an internal cathodic protection system using magnesium anodes and an inorganic zinc coating on all internal metal surfaces of the tether 10 will greatly decrease the rate of corrosion. Additionally, any air injected into the tether 10 should be substantially free of water vapor to prevent water condensation and collection at the bottom of each buoyancy cell 31.

Figure 3:
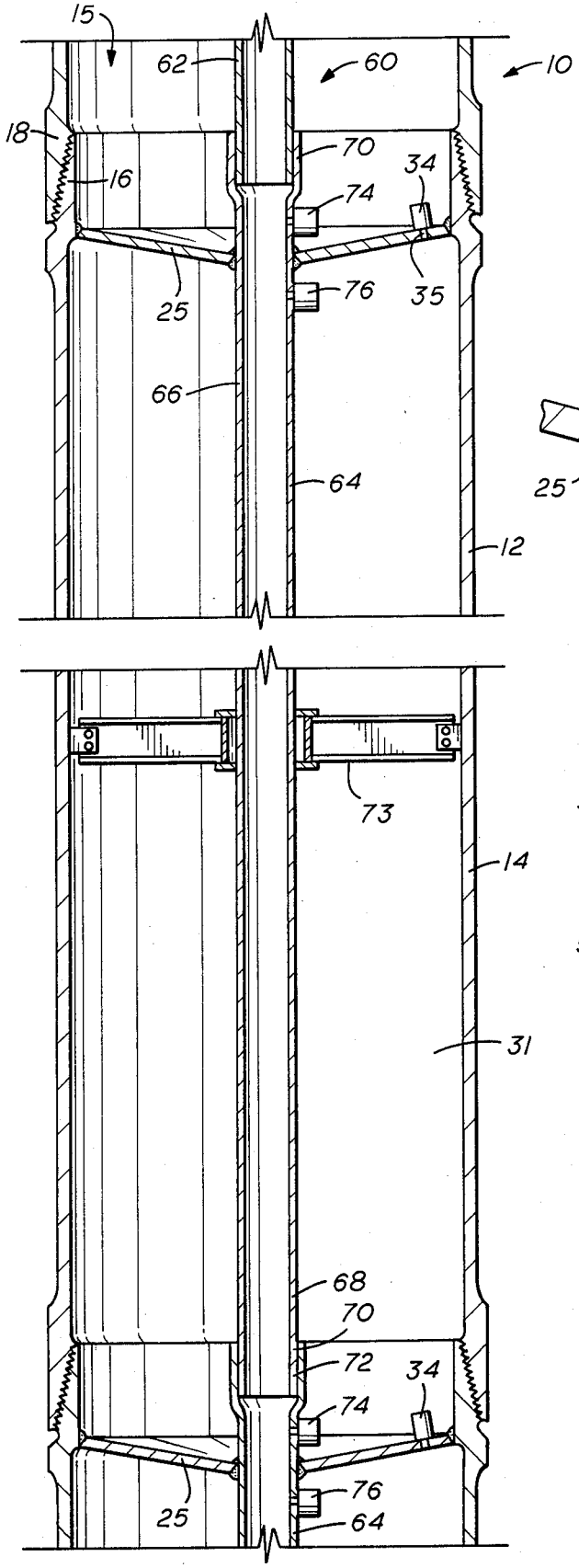
FIG. 3 shows an elevational cross section of a portion of a tension leg platform tether incorporating an alternate embodiment of the present invention.

FIG. 3 shows an alternate embodiment of the present invention. This embodiment is generally similar to the embodiment detailed above, but further includes a central access system 60 for permitting various tether operations to be carried out through the tether 10 itself. The central access system 60 serves several purposes: it provides a passage for a tool (not shown) used to activate and deactivate the tether base latch 19; it permits a ballast-deballast tool, described below, to be lowered to any selected tether section 12 to inject gas or ballast liquid into the corresponding buoyancy cell 31; and it permits passage of a buoyancy cell inspection tool (not shown).

The primary component of the central access system 60 is a central access tube 62 extending the full length of the tether 10. The access tube 62 is made up of a number of individual sections 64, each secured within a corresponding one of the tether sections 12. Each access tube section 64 has opposed first and second ends 66, 68 provided, respectively, with a box element 70 and a pin element 72. The access tube pin and box elements 72, 70 are substantially flush and concentric with, respectively, the tether section box and pin 18, 16 so that as adjoining tether sections 14 are threaded together, the access tube pin 72 of the upper tether section automatically stabs into the access tube box 70 of the lower tether section. A series of supports 73 are provided along the length of each tether section 12 to stabilize and centralize the central access tube 62 within the tether 10. The central access tube 62 defines a channel passing through each of the bulkheads 25 and extending the full length of the tether 10.

Figure 4:
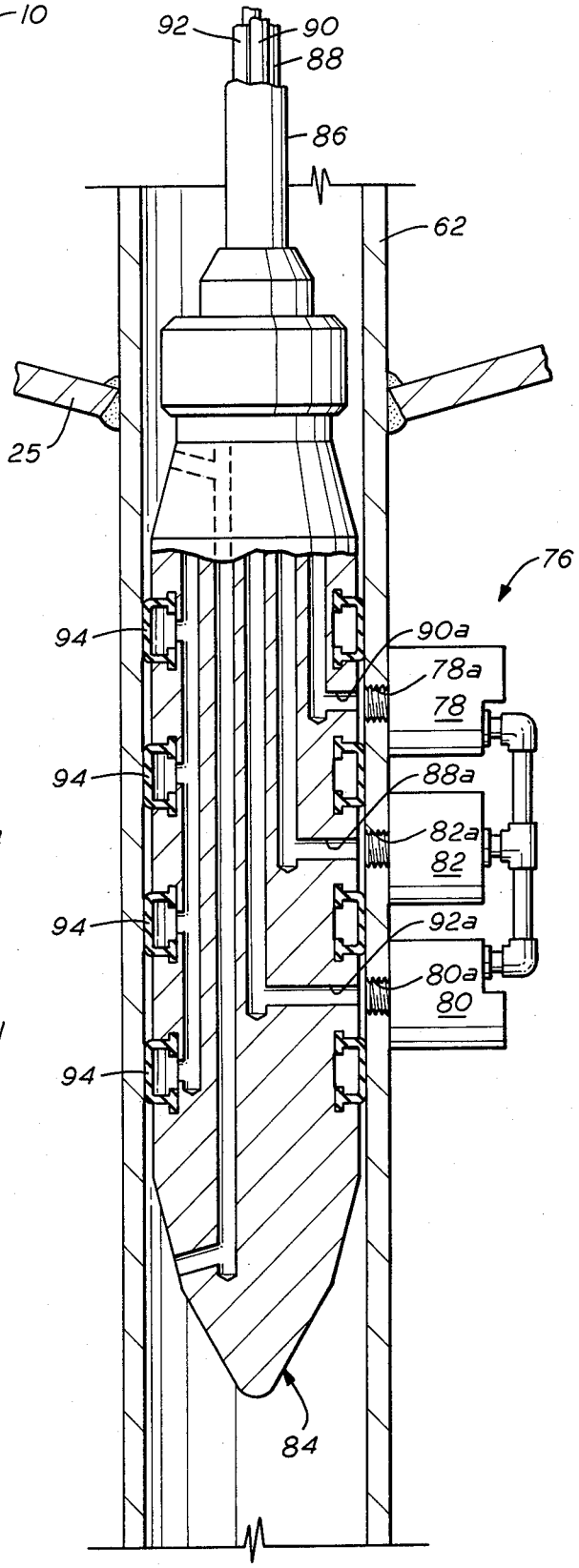
FIG. 4 shows an elevational cross section of the ballast-deballast tool situated in position to inject ballast liquid or gas into a buoyancy cell of the embodiment shown in FIG. 3.

A series of valves are secured along the length of the central access tube 62 to establish selective communication between the interior of each buoyancy cell 31 and the interior of the central access tube 62. As shown in FIG. 3, a first fluid injection valve assembly 74 is provided at the lower end of each buoyancy cell 31 and a second fluid injection valve assembly 76 is provided at the upper end of each buoyancy cell 31. As best shown in FIG. 4, each of the valve assemblies 74, 76 preferably includes two fluid transfer valves 78, 80 and a pilot signal transfer conduit 82. The fluid transfer valves 78, 80 and pilot signal conduit 82 each communicate through the wall of the central access tube 62 via corresponding ports 78*a*, 80*a*, 82*a*. A ballast-deballast tool 84 is used to inject gas or ballast liquid through the appropriate injection valve assembly 74, 76 into a desired buoyancy cell 31. Means are provided to monitor the position of the tool 84 so that it can be located precisely across from the appropriate one of the two valve assemblies 74, 76 of any buoyancy cell 31. The tool 84 can be provided with an ultrasonic transducer or other means for establishing the gas-liquid interface in each buoyancy cell 31. This facilitates identifying buoyancy cells 31 which are partially or totally flooded.

The ballast-deballast tool 84 is supported within the central access tube 62 by an umbilical 86 extending from the tool 84 to a surface control station positioned on the main body of the TLP 24. A pilot signal conduit 88, a gas flow conduit 90 and a ballast liquid flow conduit 92 extend through the umbilical 86 to corresponding ports 88*a*, 90*a*, 92*a* extending through the lateral surface of the ballast-deballast tool 84. These ports 88*a*, 90*a* and 92*a* correspond in sequence and separation to the port sets 78*a*, 80*a*, 82*a* associated with each of the valve assemblies 74, 76.

Figure 5:
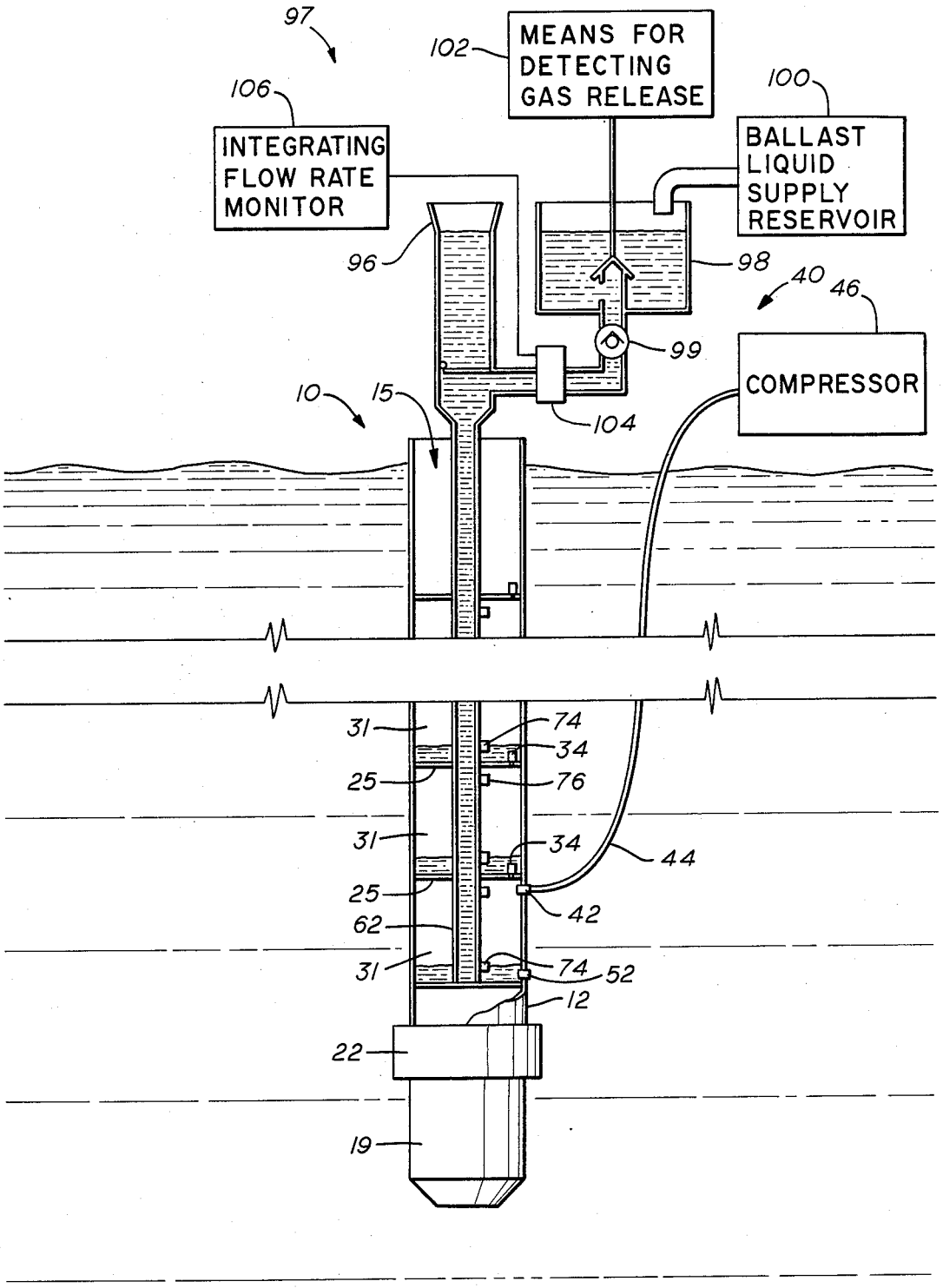
FIG. 5 shows a simplified diagrammatic view of the header tank and associated equipment used for transferring ballast liquid to and from the tether of the embodiment shown in FIG. 3.

Use of the ballast-deballast tool 84 may be illustrated by an operation to flood the lowest tether section 12 with ballast liquid prior to initiating tether removal. The ballast-deballast tool 84 is lowered through the central access tube 62 from a tool entry port 96 (FIG. 5) at the upper end of the tether 10 to the second fluid injection valve assembly 76. After the tool 84 has been situated so that the tool ports 88*a*, 90*a*, 92*a* are at the same elevation as the corresponding tether wall ports 78*a*, 80*a*, 82*a*, tool packers 94 are activated to place the corresponding port pairs in sealed fluid communication, as shown in FIG. 4. The pilot conduit 88 is pressurized, opening the two fluid transfer valves 78, 80. Ballast liquid is then injected through the ballast liquid flow conduit 92 into the buoyancy cell 31 through the corresponding fluid transfer valve 80. The gas within the buoyancy cell 31 is forced out of the buoyancy cell 31 through the other fluid transfer valve 78 and passes to the surface through the gas flow conduit 90. Once the level of ballast fluid reaches the level of the upper fluid transfer valve 78, the pilot conduit 88 is depressurized, closing the fluid transfer valves 78, 80. The packers 94 are then deactivated and the ballast-deballast tool 84 is withdrawn from the central access tube 62.

In a second version of the central access tube embodiment of the present invention, the second fluid injection valve assembly 76 is deleted. In deballasting a selected buoyancy cell 31, the ballast-deballast tool 84 is lowered to the appropriate first fluid injection valve assembly 74. After activating the packers 94, the liquid flow conduit 92 is depressurized and the gas flow conduit 90 is pressurized. This forces the ballast liquid out of the buoyancy cell 31 through the liquid flow conduit 92 to the surface and replaces the ballast liquid with gas. To ballast a selected buoyancy cell 31, ballast liquid is pumped through the liquid flow conduit 92 into the buoyancy cell 31 while maintaining pressure on the gas flow conduit 90. The gas within the buoyancy cell 31 cascades upward through the differential pressure valves 34.

It should be recognized that in most applications of the present invention it is unnecessary to ever introduce ballast liquid into any portion of the tether other than the lowermost one or two buoyancy cells 31. In this class of tethers each fluid injection valve 74, except those of the lowermost one or two buoyancy cells 31, could be adapted solely for gas injection. The fluid injection valves 74 of the lowermost one or two buoyancy cells 31 would be adapted for transferring either gas or ballast liquid to and from the corresponding buoyancy cells 31.

The internal pressure of the central access tube 62 is maintained at a higher pressure than the external pressure imposed on the central access tube 62 along the full length of the central access tube 62. This ensures that should a leak develop in the central access tube 62, the air within the buoyancy cells 31 will not vent. This is achieved by filling the central access tube 62 with a ballast liquid having a density substantially equal to that of seawater, and maintaining the level of this liquid some distance above the mean seawater level. This is accomplished within a header tank system 97 such as that diagrammatically illustrated in FIG. 5. A ballast liquid filled header tank 98 is situated at the upper end of the tether 10 and is maintained in fluid communication with the central access tube 62. The header tank 98 serves as a reservoir for the transfer of ballast liquid between the central access tube 62 and the TLP 24. A non-return valve 99 is situated intermediate the header tank 98 and the central access tube 62 to prevent uncontrolled return of ballast liquid from the central access tube 62.

The header tank system 97 is provided with a flow meter 104 and integrating flow rate monitor 106 for monitoring the instantaneous rate and cumulative magnitude of ballast liquid flow between the header tank 98 and central access tube 62. In normal operation of the tether 10 no flow should exist. The existence of a flow is indicative of a leak from the central access tube 62 into a buoyancy cell 31. Means 102 are also provided for detecting gas release into the central access tube 62. This is useful for detecting gas leakage from a buoyancy cell 31 into the central access tube 62.

The preferred embodiment of the present invention and the preferred methods of using it have been detailed above. It should be understood that the foregoing description is illustrative only, and that other means and techniques can be employed without departing from the full scope of the invention as set forth in the appended claims.

What is claimed is:

1. A buoyant tether for a tension leg offshore platform, comprising:

a tubular, load bearing wall portion adapted to extend from a foundation at the bottom of the water body in which said platform is situated to a buoyant main body of said platform proximate the surface of the water body, said wall portion defining an enclosed volume isolated from the water body by said wall portion;

a plurality of bulkheads secured to said wall portion and extending laterally across said enclosed volume, said bulkheads being spaced one from the other along the length of said tubular wall portion and serving to divide said enclosed volume into a series of buoyancy cells adapted to contain gas, said bulkheads defining fluid flow passages extending therethrough;

a plurality of valves, each of said valves corresponding to and being in sealed fluid communication with one of said bulkhead fluid flow passages, each of said valves being adapted to open to permit fluid flow through said fluid flow passage in response to the pressure differential across said bulkhead exceeding a preselected value.

2. The tether as set forth in claim 1, wherein each of said valves is adapted to open in response to a bulkhead pressure differential substantially equal to the hydrostatic pressure differential of said water body along the length of the buoyancy cell immediately below said valve.

3. The tether as set forth in claim 1, wherein each of said valves is a one-way differential pressure valve oriented to permit fluid flow upward from the buoyancy cell below said valve to the buoyancy cell above said valve in respone to the pressure differential across said bulkhead exceeding a preselected value.

4. The tether as set forth in claim 1 further including a coupling extending through said wall portion, said coupling being adapted to be connected to a gas injection conduit whereby gas may be injected through said coupling into the buoyancy cell interior to the location of said coupling.

5. The tether as set forth in claim 4, wherein said coupling is situated at the lowermost buoyancy cell, whereby gas may be injected into said lowermost buoyancy cell until the pressure within said lowermost buoyancy cell exceeds the pressure of the next buoyancy cell above by an amount equal to said preselected activation value, whereupon all additional gas injection results in a corresponding gas transfer from said lowermost buoyancy cell into the next buoyancy cell above.

6. The tether as set forth in claim 5, wherein said lowermost buoyancy cell is adapted to be selectively filled with ballast liquid, said tether further comprising means for selectively transferring said ballast liquid out of said lowermost tether section.

7. The tether as set forth in claim 1, further comprising an access tube interior to said tubular wall portion, said access tube extending substantially the full length of said tubular wall portion and passing through said bulkheads.

8. The tether as set forth in claim 7 further comprising means for injecting gas from a position interior to said access tube into at least one of said buoyancy cells.

9. The tether as set forth in claim 8 wherein said gas injection means includes a plurality of valves, each controlling the passage of fluid into a corresponding one of said buoyancy cells from said access tube.

10. The tether as set forth in claim 7 wherein said access tube is adapted to be filled with a column of ballast liquid having a height and density sufficient to maintain the internal pressure of said central access tube substantially equal to that of the seawater surrounding said tether along the full length of said tether.

11. A tether adapted for securing a buoyant offshore structure to a foundation at the bottom of a body of water, comprising:

an elongate, tubular wall member defining the load bearing portion of said tether;

a plurality of bulkheads interior to and spaced along the length of said tether, said bulkheads and said tubular wall member defining a series of buoyancy chambers extending the length of said tubular wall member, said chambers being adapted to contain gas;

an access tube within said tubular member, said access tube being substantially parallel to the central axis of said tubular member and passing through at least some of said bulkheads, said access tube being provided with a plurality of fluid communication ports along its length, there being at least one such port facing each of said buoyancy chambers;

a plurality of valves, each corresponding to one of said buoyancy chambers and being adapted to selectively establish fluid communication between such buoyancy chamber and the access tube port corresponding to said buoyancy chamber, whereby fluid communication is established between a buoyancy cell and the interior of said access tube in response to the valve corresponding to said buoyancy chamber being opened; and a plurality of differential pressure valves, each of said differential pressure valves being secured to a corresponding one of said bulkheads and being in fluid communication with a fluid flow passage extending through said bulkhead, said differential pressure valve being adapted to permit fluid communication between adjacent buoyancy cells through said fluid flow passage in response to the existence of a differential pressure of preselected magnitude across said bulkhead.

12. The tether as set forth in claim 11 further including a coupling extending through said wall portion, said coupling being adapted to be connected to a gas injection conduit whereby gas may be injected through said coupling into the buoyancy cell interior to the location of said coupling.

13. The tether as set forth in claim 12, wherein said coupling is situated at the lowermost buoyancy cell, whereby gas may be injected into said lowermost buoyancy cell until the pressure within said lowermost buoyancy cell exceeds the pressure of the next buoyancy cell above by an amount equal to said preselected activation magnitude, whereupon all additional gas injection results in a corresponding gas transfer from said lowermost buoyancy cell into the next buoyancy cell above.

14. The tether as set forth in claim 13, wherein said lowermost buoyancy cell is adapted to be selectively filled with ballast liquid, said tether further comprising means for selectively transferring said ballast liquid out of said lowermost tether section.

15. A tether and buoyancy system therefor, said tether being adapted for use in securing a tension leg offshore platform to a foundation at the bottom of a body of water, said tether and associated buoyancy system comprising:

a load bearing wall portion extending upward from said foundation to said tension leg platform, said wall portion defining an interior enclosed volume isolated from said body of water by said wall portion;

a plurality of bulkheads secured within said wall portion, said bulkheads being vertically spaced from one another and serving to divide said enclosed volume into a series of buoyancy cells each adapted to be filled with gas;

means for permitting gas to cascade from any of said buoyancy cells to the buoyancy cell above in response to the existence of a preselected pressure differential across the bulkhead separating these buoyancy cells;

a gas compressor situated on said tension leg offshore platform; and a gas conduit adapted to be at least temporarily connected between said gas compressor and one of said buoyancy cells to permit the injection of gas through said gas conduit into said one buoyancy cell.

16. The tether and buoyancy system therefor as set forth in claim 15, wherein said cascade permitting means includes:

said bulkheads each defining a fluid transfer passage extending therethrough;

a plurality of differential pressure valves, each being in sealed fluid communication with one of said fluid transfer passages.

17. The tether and buoyancy system therefor as set forth in claim 16, wherein each differential pressure valve is adapted to open in response to the existence across the corresponding bulkhead of a pressure differential substantially equal to the hydrostatic head of a column of seawater having a height equal to the height of the buoyancy cell immediately beneath said corresponding bulkhead.

18. The tether and buoyancy system therefor as set forth in claim 16, wherein each bulkhead has a plurality of fluid trasfer passages, each having a corresponding differential pressure valve in sealed fluid communication therewith.

19. The tether and buoyancy system therefor as set forth in claim 15, further including a central access tube extending through said enclosed interior of said wall portion from a position proximate the upper end of said wall portion to the lower end of said wall portion, said access tube defining a substantially unrestricted passage through said bulkheads.

20. The tether and buoyancy system therefor as set forth in claim 19, further including means for establishing selective fluid communication between the interior of said access tube and at least one of said buoyancy cells whereby fluid may be transferred into said at least one buoyancy cell from the interior of said access tube.

21. The tether and buoyancy system therefor as set forth in claim 19, further including at least one valve assembly secured to said access tube and adapted to permit fluid transfer between said access tube and the buoyancy cell adjacent said valve assembly.

22. The tether and buoyancy system therefor as set forth in claim 21, further including a tool adapted to be lowered from said platform through said central access tube to said at lease one valve assembly, said tool being adapted to inject gas through said one valve assembly into the buoyancy cell corresponding to said valve assembly.

* * * * *